US009144306B2

(12) United States Patent
Kao

(10) Patent No.: US 9,144,306 B2
(45) Date of Patent: Sep. 29, 2015

(54) TOOL HANGER

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 60 days.

(21) Appl. No.: 14/086,318

(22) Filed: Nov. 21, 2013

(65) Prior Publication Data

US 2014/0076833 A1 Mar. 20, 2014

Related U.S. Application Data

(63) Continuation-in-part of application No. 13/065,945, filed on Apr. 1, 2011, now abandoned, which is a continuation-in-part of application No. 12/284,562, filed on Sep. 23, 2008, now abandoned.

(51) Int. Cl.

| | |
|---|---|
| ***A47F 7/00*** | (2006.01) |
| ***A47B 81/00*** | (2006.01) |
| ***B25H 3/04*** | (2006.01) |
| *A47F 5/08* | (2006.01) |

(52) U.S. Cl.
CPC *A47B 81/00* (2013.01); *B25H 3/04* (2013.01); *A47F 5/0838* (2013.01)

(58) Field of Classification Search
USPC ..... 211/70.6, 57.1, 59.1, 94.01, 113, 69; 206/378, 376, 377, 372; 248/682, 690, 248/686, 214, 227.4, 232.71, 316.1, 317
See application file for complete search history.

(56) References Cited

U.S. PATENT DOCUMENTS

| | | | | |
|---|---|---|---|---|
| 2,683,891 | A | 7/1954 | Rosenbaum | |
| 2,754,974 | A | 7/1956 | Larson | |
| 2,805,777 | A | 7/1957 | Larson | |
| 3,352,429 | A | 11/1967 | Magnuson | |
| 4,474,300 | A | 10/1984 | Entis | |
| 4,700,917 | A | 10/1987 | Dillman | |
| 4,717,106 | A | 1/1988 | Bies et al. | |
| D353,502 | S | 12/1994 | Liu | |
| 5,887,731 | A | 3/1999 | Thalenfeld | |
| 5,908,120 | A | 6/1999 | Yates et al. | |
| 6,250,466 | B1 | 6/2001 | Ernst | |
| D456,150 | S | 4/2002 | Moore | |
| 6,571,966 | B1 | 6/2003 | Hsiao | |
| D478,805 | S | 8/2003 | Winig et al. | |
| 6,601,808 | B1 | 8/2003 | Nagel | |
| 7,258,239 | B2 | 8/2007 | Kao | |
| 8,251,342 | B1 | 8/2012 | Weiner | |
| 2004/0188032 | A1 | 9/2004 | Jackson | |
| 2004/0195192 | A1 | 10/2004 | Belokin et al. | |
| 2007/0007222 | A1 | 1/2007 | Kao | |
| 2007/0017886 | A1 * | 1/2007 | Kao | 211/94.01 |
| 2007/0158287 | A1 | 7/2007 | Sarajian | |

* cited by examiner

*Primary Examiner* — Joshua J Michener
*Assistant Examiner* — Devin Barnett
(74) *Attorney, Agent, or Firm* — William E. Pelton; Cooper & Dunham LLP

(57) ABSTRACT

A tool hanger has a rail and multiple hanging blocks. The rail is an elongated bar and has at least one hole. The hanging blocks are mounted slidably on the rail and are adjustable in distances between the hanging blocks on the rail. Each hanging block has a hanging body, an arm, a hook and an escaping recess. The hanging body has a sliding slot being slidably mounted on the rail. The arm protrudes from the hanging body and has a cylinder. The hook is attached to the arm. The hook is attached to the arm. The escaping recess is formed in the bottom surface at the free end of the hook to form an escaping segment on the free end of the hook and having a depth smaller than that of a segment of the hook opposite to the free end.

1 Claim, 5 Drawing Sheets

TOOL HANGER

The present application is a continuation-in-part application (CIP) of the application Ser. No. 13/495,214, filed on Jun. 13, 2012, now abandoned that is CIP of the application Ser. No. 13/065,945, filed on Apr. 1, 2011, now abandoned that is a CIP of the application Ser. No. 12/284,562, filed on Sep. 28, 2008, now abandoned.

BACKGROUND OF THE INVENTION

1. Field of the Invention

The present invention relates to a tool hanger, especially to a tool hanger being able to hang more tools and being made with less material.

2. Description of the Prior Art

A conventional tool hanger is used to hang and display socket wrench adapters or box-end wrenches and comprises a rail and multiple hanging blocks. The hanging blocks are slidably attached to the rail. Each hanging block has a cylinder or a hook for hanging a socket wrench adapter "adapter" or a box-end wrench "wrench".

A hanging block of the conventional tool hanger can only hang one specific kind of tool. To hang adapters and wrenches on the tool hanger, multiple different hangers in different kinds and sizes are necessary. However, arranging different tool hangers requires lot of material for production and increases cost for manufacturing the tool hanger. In addition, each hanging block of the conventional tool hanger can only hang one specific kind of tool and is not versatile in use.

U.S. Pat. No. 7,258,239, entitled to "Hanger Rack for Hand Tools" discloses a hanger rack comprising multiple fixture pieces moveably mounted on a bar. However, the fixture pieces of the '239 Patent can only hold a single specific tool.

U.S. Pat. No. 2,805,777, entitled to "Tool Holder" discloses a tool holder comprising an upper bracket and two plates combined with the upper bracket. Multiple fingers and multiple beads are formed respectively on the plates. However, the tool holder of the '777 Patent are composed of three bracket and plates, so to assemble the tool holder is laborious. In addition, the distances between the fingers and beads are not adjustable, so the tool holder is not versatile in use.

U.S. Design No. D478,805, entitled to "Hook Assembly" discloses a hook assembly having a hook segment. However, the hook assembly can only be applied to hang a single objection.

To overcome the shortcomings, the present invention provides a tool hanger to mitigate or obviate the aforementioned problems.

SUMMARY OF THE INVENTION

The main objective of the invention is to provide a tool hanger being able to hang more tools and being made with less material.

The tool hanger in accordance with the present invention has a rail and multiple hanging blocks. The rail is an elongated bar and has at least one hole. The hanging blocks are mounted slidably on the rail and are adjustable in distances between the hanging blocks on the rail. Each hanging block has a hanging body, an arm, a hook and an escaping recess. The hanging body has a sliding slot being slidably mounted on the rail. The arm protrudes from the hanging body and has a cylinder. The hook is attached to the arm. The escaping recess is formed in the bottom surface at the free end of the hook to form an escaping segment on the free end of the hook and having a depth smaller than that of a segment at an end of the hook opposite to the free end.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
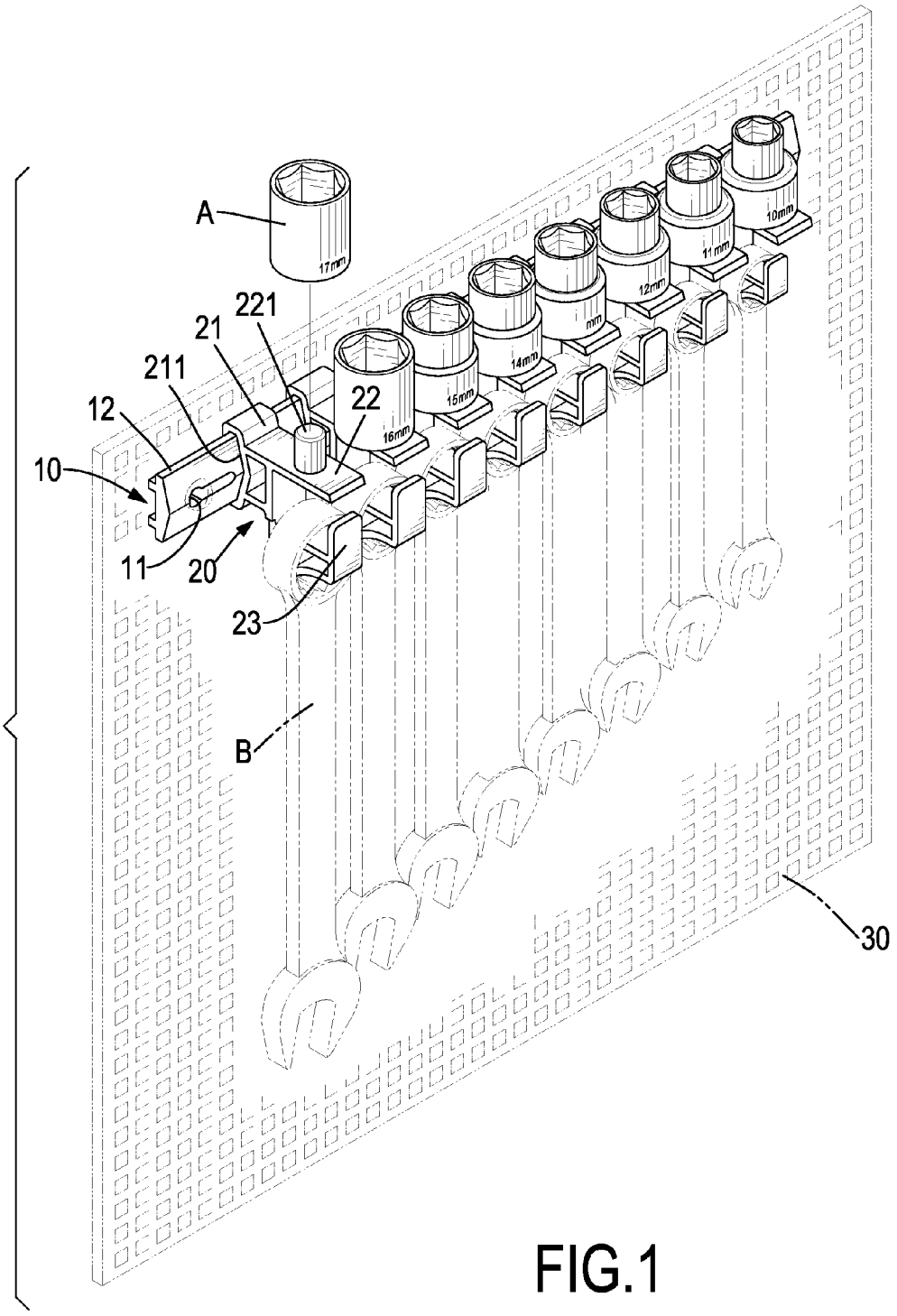
FIG. 1 is an exploded prospective view of a tool hanger in accordance with the present invention.
Figure 2:
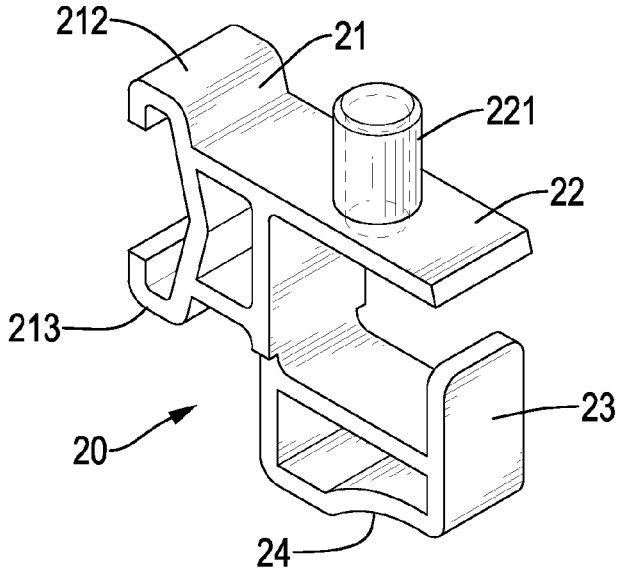
FIG. 2 is a prospective view of a hanging block of the tool hanger in FIG. 1.
Figure 3:
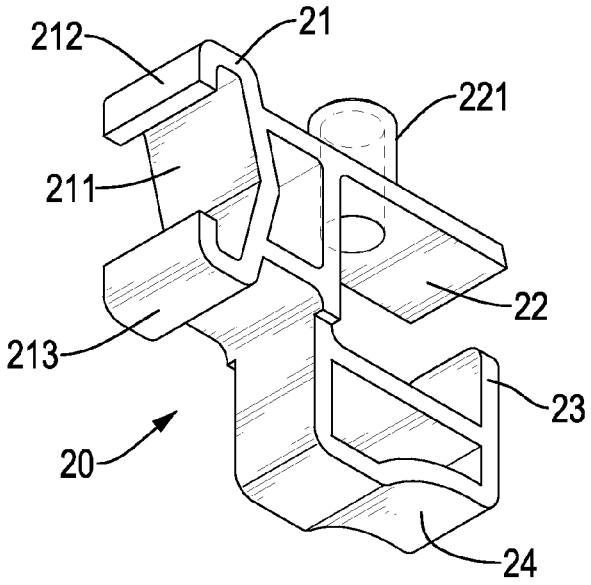
FIG. 3 is another prospective view of the hanging block in FIG. 2.
Figure 4:
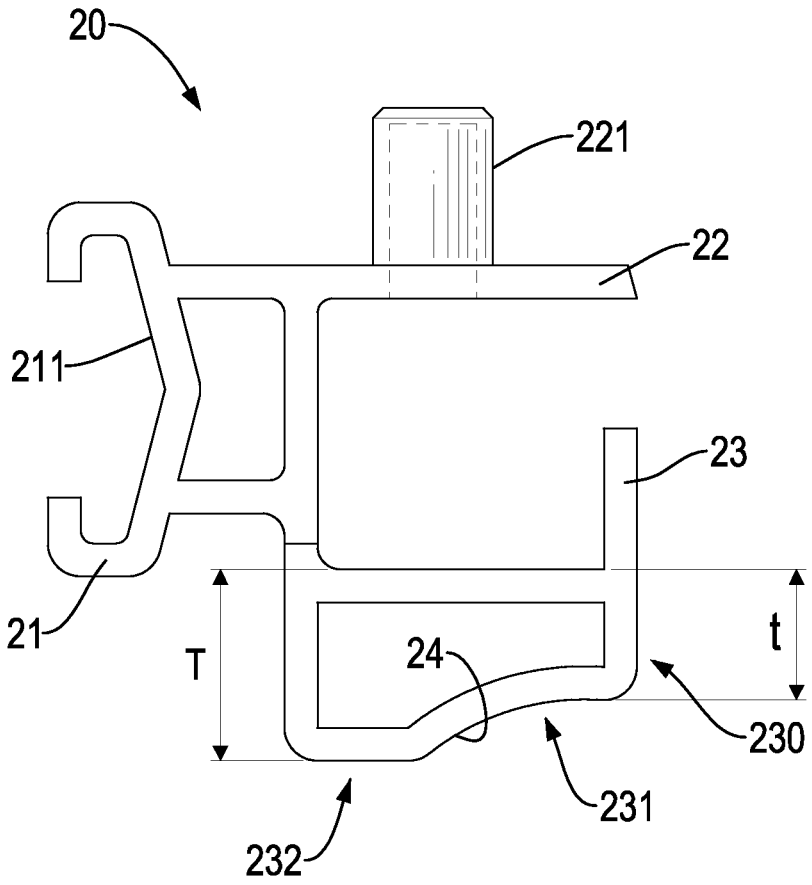
FIG. 4 is a side view of the hanging block in FIG. 2.

With reference to FIGS. 1 to 4, a tool hanger in accordance with the present invention comprises a rail 10 and multiple hanging blocks 20. The rail 10 is an elongated bar and comprises at least one hole 11. The rail 10 comprises two ends and two holes 11 being respectively defined near the ends of the rail 10. The at least one hole 11 is used to attach the rail 10 to a supporting board 30 for allowing the tool hanger to be displayed in an exhibition area or around a tool cart. Furthermore, the rail 10 comprises a top, a bottom and two edges 12 respectively formed on the top and the bottom of the rail 10.

The hanging blocks 20 are mounted slidably on the rail 10 and are adjustable in distances between the hanging blocks 20 on the rail 10. Each hanging block 20 comprises a hanging body 21, an arm 22, a hook 23 and an escaping recess 24. The hanging body 21 comprises a front and a sliding slot 211 being slidably mounted on the rail 10 and having an upper mounting plate 212 and a bottom mounting plate 213. The upper mounting plate 212 is attached to the edge 12 of the top of the rail 10. The bottom mounting plate 213 is attached to the edge 12 of the bottom of the rail 10. The hanging block 20 is slidably mounted to the rail 10 by attaching the upper mounting plate 212 and the bottom mounting plate 213 respectively to the edges 12 of the rail 10.

The arm 22 is formed on and protrudes from the front of the hanging body 21 and comprises a distal end, a proximal end, a top, a bottom surface and a cylinder 221 protruding from the top. The proximal end is attached to the front of the hanging body 21. The top is a horizontally flat surface.

The hook 23 is attached to the bottom surface between the distal end and the proximal end of the arm 22 and is positioned lower than the top of the arm 22. An opening is formed between the hook 23 and the distal end of the arm 22. The escaping recess 24 is formed in the bottom surface at the free end 230 of the hook 23 and has a curved bottom, such that an escaping segment 231 is formed on the free end 230 of the hook 23. The escaping segment 231 has a depth "t" smaller than the depth "T" of a segment 232 at an end of the hook 23 opposite to the free end of the hook 23.

Other than the tool hanger in accordance with the present invention which has two holes 11 respectively defined near the ends of the rail 10, the tool hanger may have only one hole 11 or have many holes 11 defined in the rail 10. The hole 11 or holes 11 are fit with fasteners, such as screws or bolts to attach the rail 10 onto a supporting board 30. In other words, the number of the at least one hole 11 is not specifically limited in the present invention.

Figure 5:
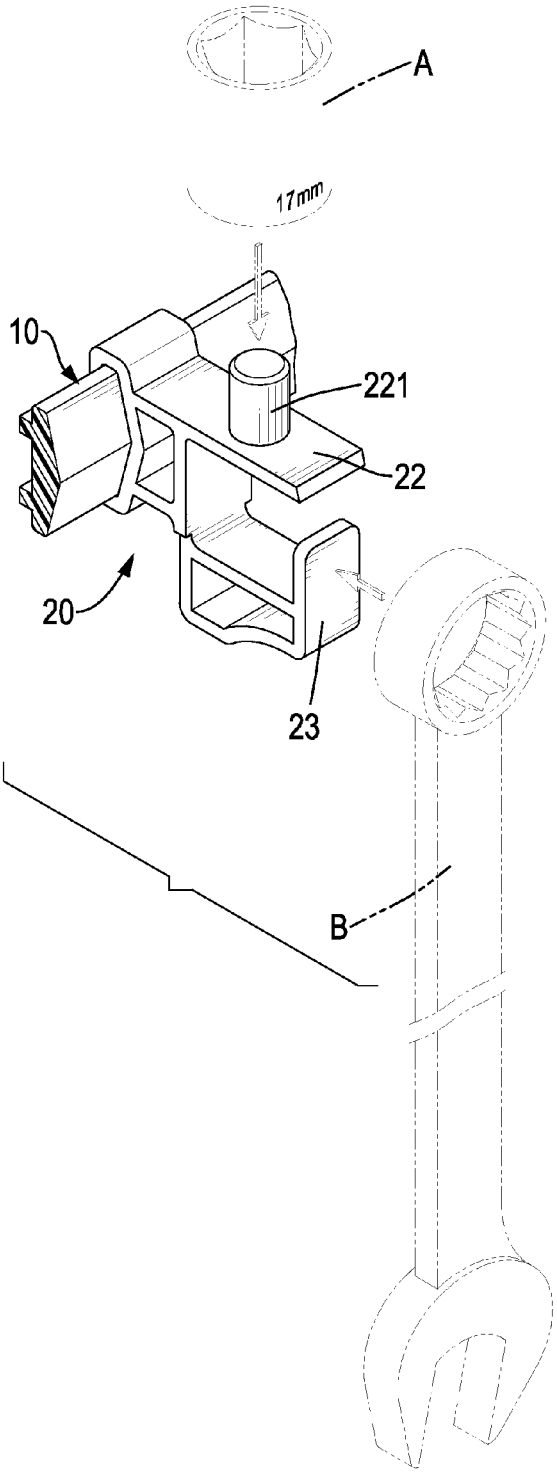
FIG. 5 is an exploded prospective view of the tool hanger in FIG. 1 being used with an adapter and a wrench.
Figure 6:
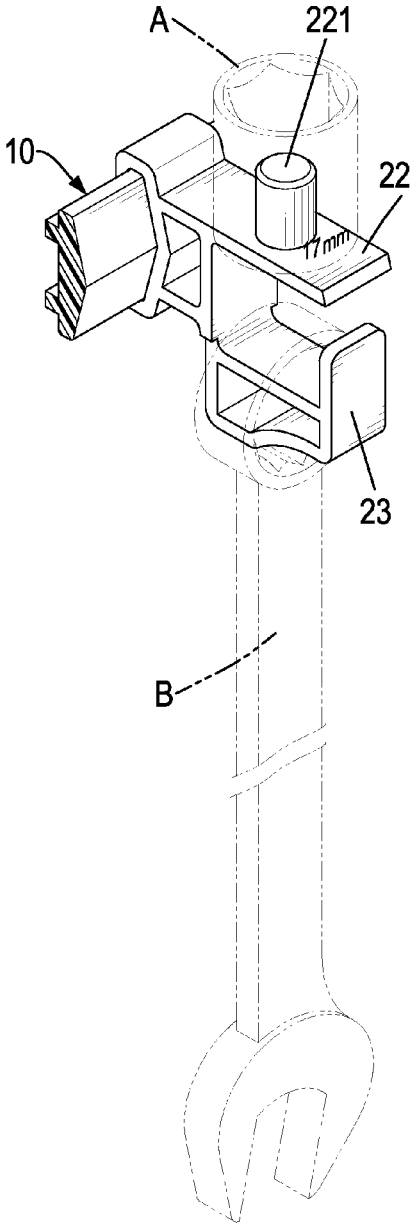
FIG. 6 is a prospective view of the tool hanger in FIG. 5 being used with an adapter and a wrench.
Figure 7:
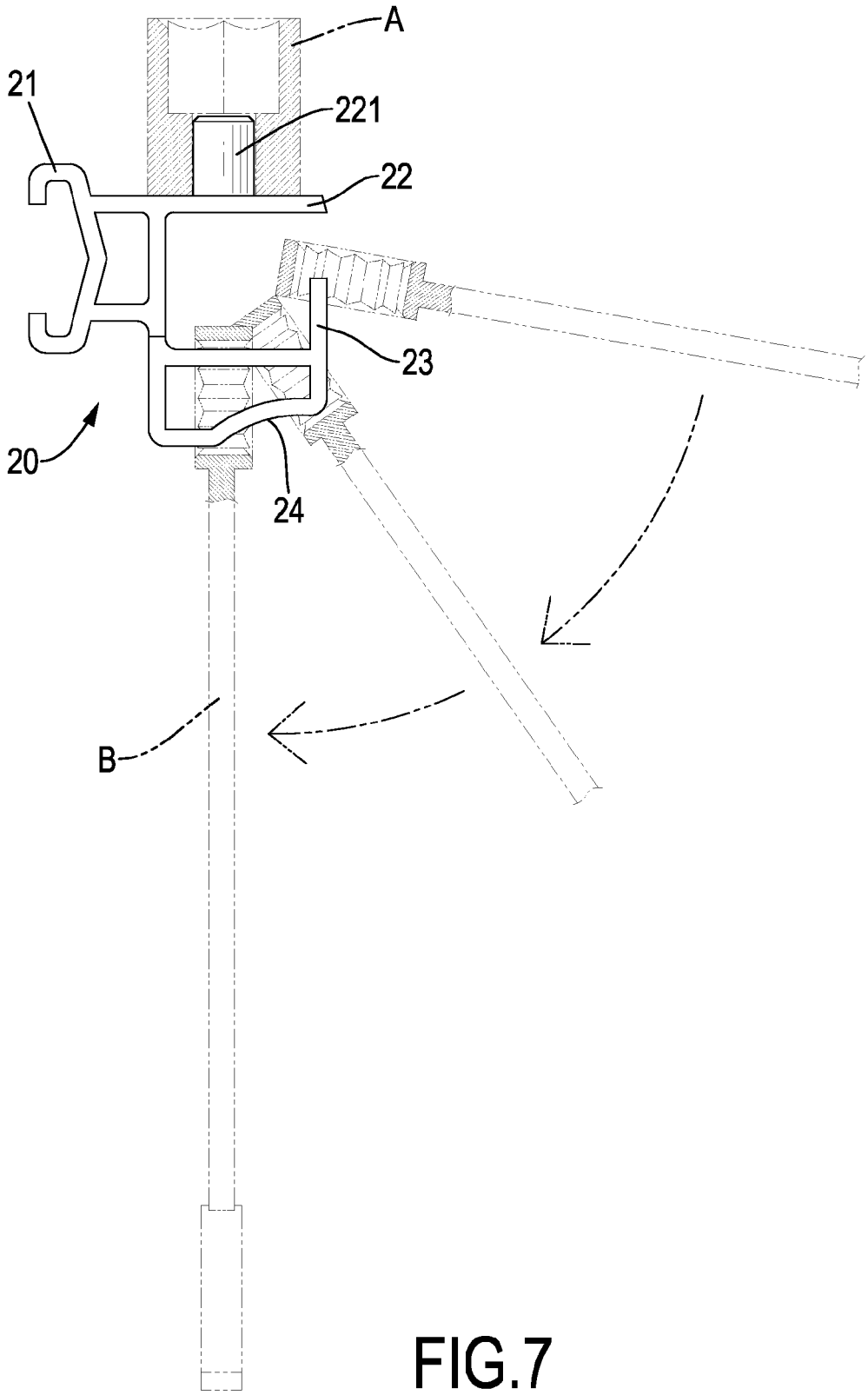
FIG. 7 is an operational side view of the hanging block in FIG. 6 being used with an adapter and a wrench.

With reference to FIGS. 1 and 5 to 7, in use, the rail 10 is attached to a supporting board 30 with fasteners and the cylinder 221 and the hook 23 of the hanging block 20 hold an adapter A and a wrench B, respectively. The cylinder 221 holds an adapter A in place and the hook 23 holds a wrench B to hang two kinds of tools on a same hanging block 20, such that each hanging block 20 of the tool hanger in accordance with the present invention can hold multiple tools and is versatile in use. Because each hanging block 20 can hold two adapter A and wrench B, the material and cost for manufacturing a tool hanger that has a capability of holding a same amount of tools as a conventional one can be reduced.

The hook 23 is inserted to a box of the wrench B whereas a rim of the box is inserted in the opening formed between the hook 23 and the distal end of the arm 22 and then rested on the hook 23, so as to hang the wrench B thereon. With the arrangement of the escaping recess 24 on the free end 230 of the hook 23, the box of the wrench B can easily and smoothly pass the thinner escaping segment 231 on the hook 23 to prevent the wrench B from being blocked while the box of the wrench B is mounted around the hook 23. Therefore, to hang the wrench B onto the hook 23 is smooth and convenient.

A portion of the arm 22 that ranges from where the hook 23 is attached to the distal end of the arm 22 protrudes over the hook 23 and secures the hung wrench B from dropping off. Thus, multiple tools are simultaneously held on a single hanging block 20. In addition, the tool hanger in accordance with the present invention also provides functions of material saving and ease-recognition of diameter levels of the adapters.

Furthermore, because the hanging blocks 20 are slidable relative to the rail 10, the distances between the hanging blocks 20 on the rail 10 are adjustable to hang different tools of different types and sides on the hanging blocks 20. The tool hanger in accordance with the present invention can fit with different use needs and is versatile in use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tool hanger system comprising a rail comprising at least one hole; and multiple hanging blocks slidably mounted on the rail and adjustable within spaces available between the hanging blocks on the rail, each multiple hanging block consisting of:

a hanging body comprising a front; and a sliding slot being slidably mounted on the rail;

an arm formed on and protruding from the front of the hanging body, the arm includes a distal end; a proximal end attached to the front of the hanging body; a bottom surface; a top; and a cylinder protruding from the top;

a hook attached to the bottom surface of the arm between the distal end and the proximal end of the arm, and having a hollow portion partially defined by a downwardly tapered escaping recess on a bottom section of the hook positioned at a position lower than the top of the arm and having a free end, wherein an opening is formed between the hook and the distal end of the arm; and an escaping segment at the free end of the hook defined by the downwardly tapered escaping recess on the bottom section of the hook, and the hollow portion of the hook having a depth that is defined between a bottom surface of the hook and a top surface of the hook, wherein the depth of the hollow portion at the free end of the hook is smaller than the depth of the hollow portion of the hook at an end of the hook opposite to the free end of the hook.

* * * * *